United States Patent [19]

Bautista

[11] Patent Number: 4,883,945

[45] Date of Patent: Nov. 28, 1989

[54] CONNECTOR FOR ELECTRICAL HEATER

[75] Inventor: Richard L. Bautista, Union City, Calif.

[73] Assignee: Raychem Corporation, Menlo Park, Calif.

[21] Appl. No.: 281,580

[22] Filed: Dec. 8, 1988

[51] Int. Cl.[4] ..... H01R 9/03

[52] U.S. Cl. ..... 219/541; 439/721; 439/723

[58] Field of Search ..... 219/538, 541; 439/465, 439/467, 721, 723, 793, 794, 797

[56] References Cited

U.S. PATENT DOCUMENTS

| | | | |
|---|---|---|---|
| 1,454,858 | 5/1923 | Price | 439/467 |
| 2,610,996 | 9/1952 | Rickabaugh | 439/721 |
| 4,153,326 | 5/1979 | Frantz | 439/465 |
| 4,722,701 | 2/1988 | Bradt | 439/721 |

*Primary Examiner*—A. D. Pellinen
*Assistant Examiner*—Leon K. Fuller
*Attorney, Agent, or Firm*—Marguerite E. Gerstner; Timothy H. P. Richardson; Herbert G. Burkard

[57] ABSTRACT

A connector which is suitable for connecting an elongate heater to an elongate compartment and which provides strain relief by gripping the heater in a manner which forces it into a serpentine configuration. The connector is particularly useful for heaters which comprise an outer insulating jacket surrounded by a metallic grounding braid. The elongate component may comprise a power lead or one or more elongate heaters.

16 Claims, 7 Drawing Sheets

FIG_1A
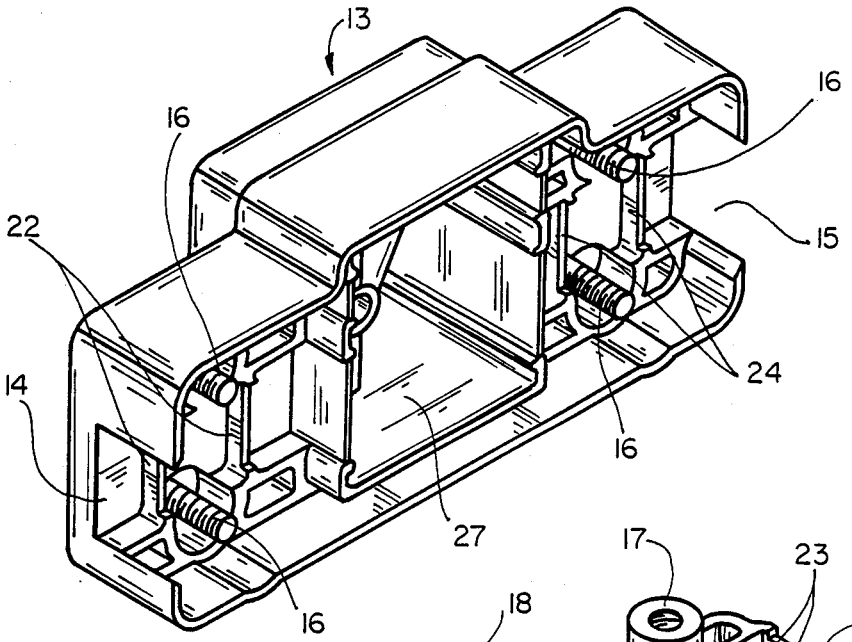
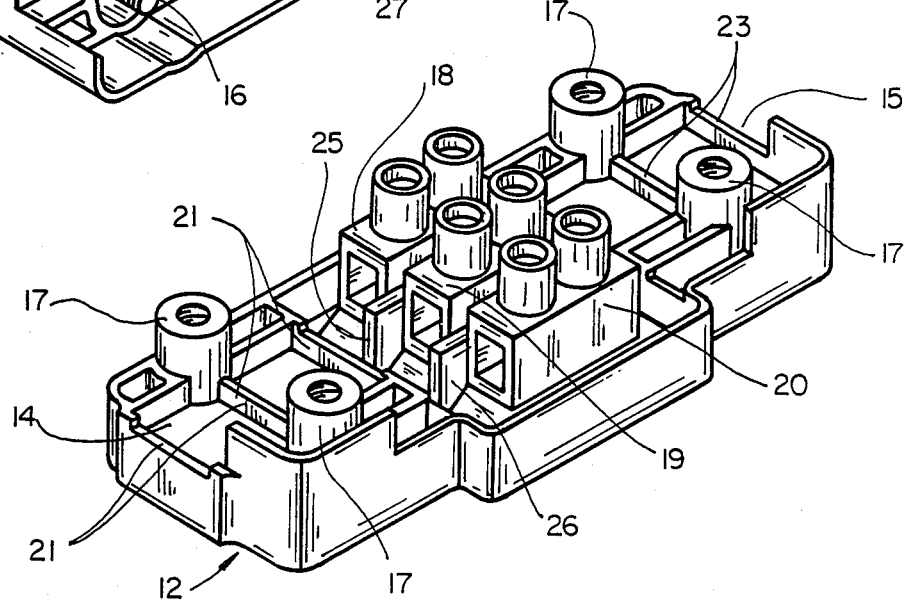
FIG_1B

FIG_4A
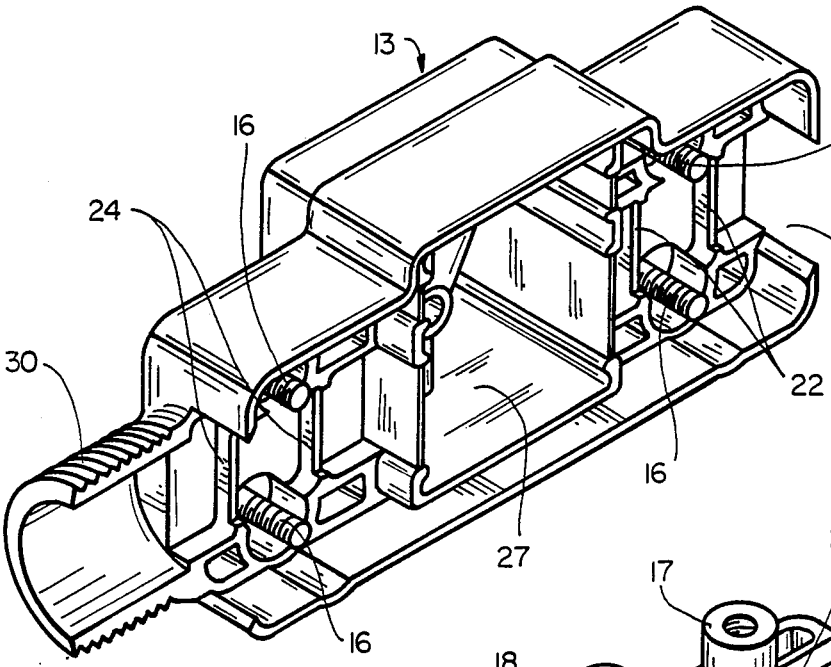
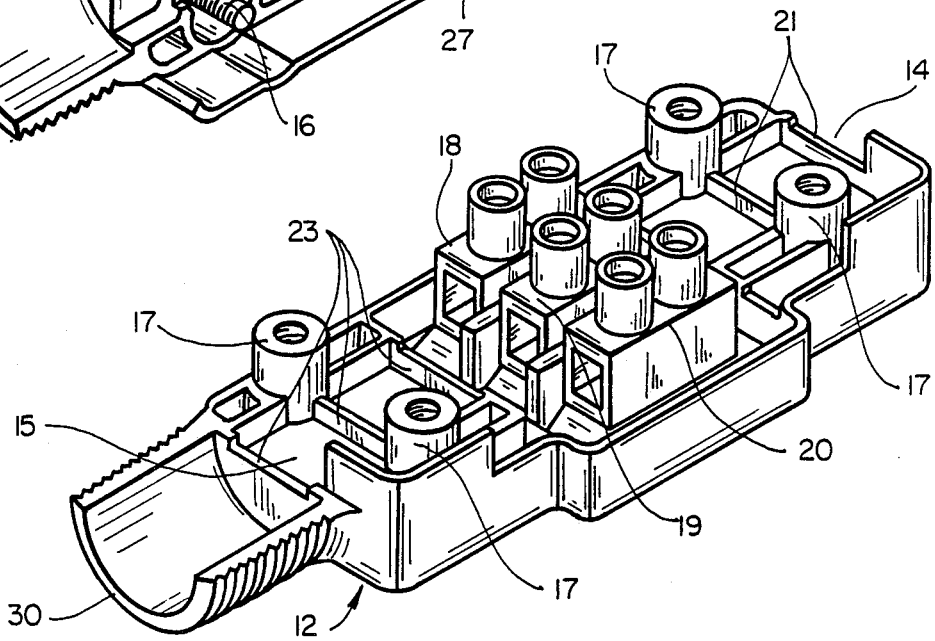
FIG_4B

CONNECTOR FOR ELECTRICAL HEATER

CROSS-REFERENCE TO RELATED APPLICATIONS

This application is related to U.S. application Ser. No. 282,250 (Oiwa) filed contemporaneously with this application, the disclosure of which is incorporated herein by reference.

BACKGROUND OF THE INVENTION

1. Field of the Invention

This invention relates to connectors for elongate electrical heaters.

2. Introduction to the Invention

Elongate electrical heaters are well known and are used, for example, to prevent the freezing of pipes or to maintain process temperatures within pipes. Particularly useful elongate heaters comprise (a) first and second elongate electrodes, (b) a plurality of resistive heating elements connected in parallel between said electrodes, e.g. a continuous strip of a conductive polymer in which the electrodes are embedded or which is wrapped around the electrodes, and (c) an insulating jacket which surrounds the electrodes and the heating elements. It is often necessary to make an electrical connection from the elongate electrical heater, to another element, e.g. another heater or a power cord. Conventional methods of making such a connection by means of grommets, crimps, or heat-shrinkable sleeves have not satisfactoriy solved two problems which occur with such connections: adequate strain relief of the elongate heater and adequate sealing to prevent moisture, from such sources as condensation, from contacting the connection, e.g. after wicking down the heater. These problems are particularly serious when the elongate heater comprises a conductive metal braid which surrounds the insulating jacket and is for use in grounding the heater. Both the braid and the insulating polymer jacket must be adequately gripped in order to provide acceptable mechanical "pullout" strength, produce adequate strain relief, and prevent slipping of the insulating jacket with respect to the braid. In addition, the braid accelerates the wicking of moisture into the area of electrical connection. In order to provide an acceptable environmental seal, conventional connectors have utilized mastic, heat-shrinkable tubing, or resilient grommets. The resulting connector, which often must be prepared specifically for each size of heater and may comprise many components, may be bulky, requires craft-sensitive installation and cannot be easily reentered in order to modify the splice or check continuity of the connection and/or heater.

SUMMARY OF THE INVENTION

I have now designed a connector which is suitable for making electrical connection between an elongate electrical heater and an elongate electrical component. This connector is useful for making connections in which there is both adequate strain relief and adequate moisture sealing, and, in addition, can be used to make connections for multiple heaters of a variety of sizes. The resulting connection has acceptable mechanical pullout strength, provides separation between the electrodes to minimize electrical shorting, is compact and reenterable, increases connection reliability, and reduces assembly time and craft sensitivity. In addition, the connector is versatile, allowing splices to a variety of electrical components to be made. In a first aspect, this invention provides a connector for connecting an end of an elongate electrical heater to an end of an elongate electrical component, said heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, and said electrical component comprising first, second and third elongate members for connection to the first electrode, the second electrode, and the grounding braid respectively, said connector comprising (1) first and second shell members which can be in (a) a demated configuration or (b) a mated configuration in which the shell members are in contact with each other and form a shell having a first inlet port for the heater and a second inlet port for the electrical component;

(2) securing means for releasably maintaining the shell members in the mated configuration;

(3) a first terminal block for connecting the first electrode to the first elongate member of said electrical component within the shell;

(4) a second terminal block for connecting the second electrode to the second elongate member of said electrical component within the shell;

(5) a third terminal block for connecting the grounding braid to the third elongate member of said electrical component within the shell; and (6) a plurality of first gripping members associated with the first shell member, and at least one second gripping member associated with the second shell member, the first and second gripping members being such that, when the shell members are brought from the demated configuration into the mated configuration after the electrical heater has been connected to the electrical component via the terminal blocks within the connector, the gripping members are forced against opposite faces of the heater within the shell adjacent the first inlet port and at longitudinally spaced intervals on the heater, thus forcing the heater to form a serpentine configuration.

In a second aspect this invention provides an assembly comprising a connector, an end of an elongate electrical heater and an end of an elongate electrical component, said heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, and said electrical component comprising first, second and third elongate members which are connected to the first electrode, the second electrode and the grounding braid respectively, said connector comprising (1) first and second shell members which are in a mated configuration in which the shell members are in contact with each other and form a shell having a first inlet port for the heater and a second inlet port for the electrical component;

(2) securing means which releasably maintain the shell members in the mated configuration;

(3) a first terminal block which is secured to the first shell member and which connects the first electrode to the first elongate member of said electrical component within the shell;

(4) a second terminal block which is secured to the first shell member and which connects the second electrode to the second elongate member of said electrical component within the shell;

(5) a third terminal block which is secured to the first shell member and which connects the grounding braid to the third elongate member of said electrical component within the shell;

(6) a plurality of first gripping members which are associated with the first shell member and a plurality of second gripping members which are associated with the second shell member, the first and second gripping members being forced against opposite faces of the heater within the shell adjacent the first inlet port and at longitudinally spaced intervals on the heater, thus forcing the heater to form a serpentine configuration;

(7) a gel component which is within the shell and which is deformed and seals around the first, second and third terminal blocks;

(8) a first insulating barrier which lies between the first and second terminal blocks and extends outwardly therefrom towards the first inlet port; and (9) a second insulating barrier which lies between the second and third insulating blocks and extends outwardly therefrom towards the first inlet port substantially further than the first insulating barrier, the insulating jacket being directly contacted by (a) the gel component, (b) at least one first gripping member and (c) at least one second gripping member, and the metallic grounding braid being contacted, directly or through an outer insulating jacket which surrounds the braid, by (a) at least one first gripping member which is different from that which directly contacts the insulating jacket and (b) at least one second gripping member which is different from that which directly contacts the insulating jacket.

BRIEF DESCRIPTION OF THE DRAWING

The invention is illustrated by the drawing in which FIGS. 1*a* and 1*b* are perspective views of the components of a connector suitable for making a splice between two heaters;

FIGS. 4*a* and 4*b* are perspective views of the components of a connector suitable for making a power connection;

DETAILED DESCRIPTION OF THE INVENTION

Figure 2:
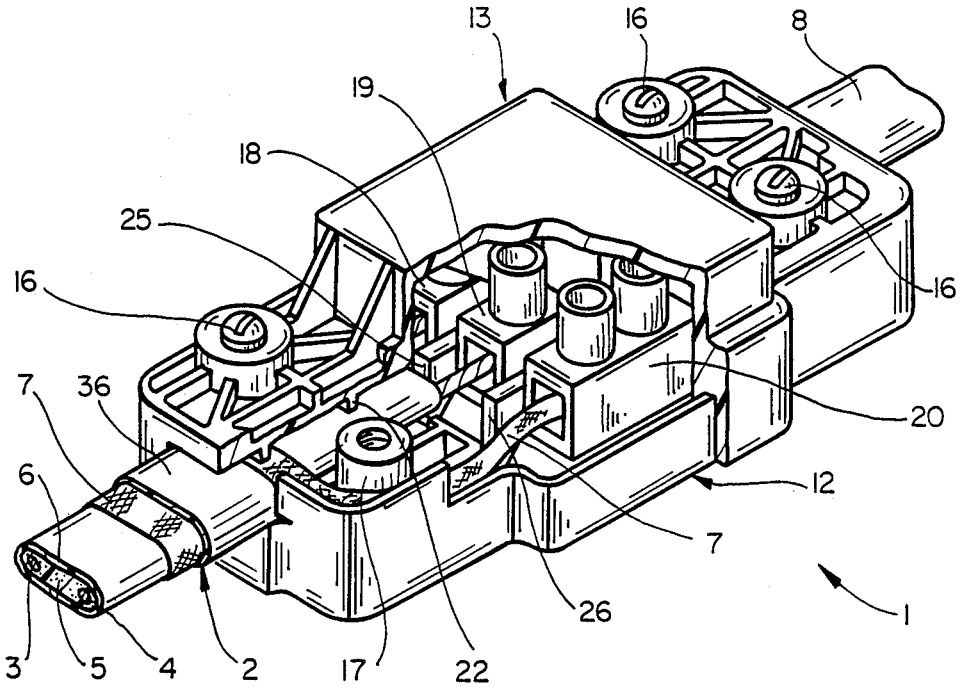
FIG. 2 is a perspective view of the connector of FIGS. 1*a* and 1*b* in a mated configuration.

Elongate electrical heaters appropriate for use with this connector are those which comprise first and second elongate electrodes, a plurality of resistive heating elements connected in parallel between the electrodes, and an insulating jacket surrounding the electrodes and heating elements. Self-regulating strip heaters in which the electrodes comprise elongate wires and the resistive heating elements comprise a conductive polymer composition are particularly suitable. Heaters of this type are well known; see, for example, U.S. Pat. Nos. 3,858,144 (Bedard et al) 4,017,715 (Whitney et al), 4,242,573 (Batliwalla), 4,246,468 (Horsma), 4,334,148 (Kampe), 4,334,351 (Sopory), 4,398,084 (Walty), 4,400,614 (Sopory), 4,425,497 (Leary), 4,426,339 (Kamath et al), 4,459,473 (Kamath) 4,547,659 (Leary), 4,582,983 (Midgley et al), 4,574,188 (Midgley et al), 4,659,913 (Midgley et al), 4,661,687 (Afkhampour et al), 4,673,801 (Leary), and 4,764,664 (Kamath et al), the disclosure of each of which is incorporated herein by reference. In order to provide electrical insulation and environmental protection, the resistive heating elements are surrounded by an electrically insulating jacket which is often polymeric, but may be any suitable material. This jacket may be loosely fitted around or tightly bonded to the heating elements. The jacket may itself be surrounded by a metallic grounding material which is preferably in the form of a braid, although a sheath or other configuration may be suitable if flexibility of the heater is not crucial. In addition to serving to electrically ground the heater, the grounding braid provides mechanical strength. The braid itself may be surrounded by an outer polymeric jacket. The resulting heater frequently has an approximately rectangular cross-section with two generally parallel faces, although other geometries (e.g. elliptical, oval, round) are also appropriate.

The elongate electrical component to be connected to the heater may comprise another heater or a plurality of heaters, a power cord, a grounded power lead, a plurality of electrical cables or another suitable element. In order to make adequate connection to the heater the component will comprise first, second, and third elongate members for connection to the first electrode, the second electrode, and the grounding braid, respectively. The configuration of the component and the resulting configuration of the connector will depend on what type of connection is to be made, e.g. a splice between two heaters, a connection between a heater and a power cord, or a T or Y connecting a heater to two other heaters.

The connector itself comprises first and second shell members which are capable of existing in a demated or a mated configuration. In the demated configuration the shell members may be separate pieces or they may be connected, e.g. by hinges or straps. When mated, the shell members are in contact with each other (directly or through a sealing member, e.g. a gasket) and, as such, form a shell which provides a first inlet port for the heater and a second inlet port for the electrical component. In connectors which are intended for connection of two or more heaters or other components, the shell members may be designed to provide multiple inlet ports when mated. The first and second inlet ports are commonly positioned at opposite ends of the shell (e.g. suitable for a splice), but may be positioned at right angles to one another. When two or more heaters or components are to be connected, the second inlet ports for the electrical components may be adjacent one another in a stacked or side-by-side arrangement, or may each be positioned on different faces of the shell from the first inlet port. When the connection is between a heater and a power cable, the second inlet port may be positioned on the top or bottom surface of the shell. A single first shell member may be suitable for use with a variety of second shell members or vice versa. For example, a shell member which has a second inlet port designed for multiple components may be connected to a shell member with a second inlet port for a single component by inserting a piece which will close off the unused section of the inlet port. The shell members are maintained in their mated configuration by means of a securing means such as a strap, a spring clamp, a screw or a plurality of screws. The securing means may be removable in order to allow the shell members to be demated from one another and to allow the connector to be re-enterable. Within the shell, at least three terminal blocks are present: a first terminal block for electrically connecting the first electrode of the heater to the first elongate member of the electrical component, a second terminal block for electrically connecting the second electrode of the heater to the second elongate member of the electrical component, and a third terminal block for electrically connecting the grounding braid to the third elongate member of the electrical component. It is preferred that the terminal blocks be secured to one of the shell members of the shell. In this context, the term "terminal block" is used to mean any housing, molded body, or spatial region which is insulated and provides a site for electrical connection.

When making a connection it is important that the heater be held in position with sufficient strength so that it cannot readily be pulled out of the connector. Often a "pullout force" of at least 25 pounds, preferably at least 30 pounds, particularly at least 35 pounds is required for routine use. (The pullout force is measured with an Instron TM tensile testing apparatus. The heater is gripped by one jaw of the Instron and the connector by the other jaw. The force required to pull the heater 0.125 inch (0.318 cm) out of the connector when the jaw holding the connector is stationary and the jaw holding the heater is moved is measured.) When the heater comprises both an inner jacket and a grounding braid, both the jacket and the braid must be secured in order to avoid slipping of one past the other if pulled. Acceptable gripping on both of these parts is provided by the connector of this invention which comprises a plurality of first gripping members associated with the first shell member and at least one second gripping member associated with the second shell member. The first and second gripping members, which are also referred to herein as "teeth", are positioned and dimensioned such that when, after the heater has been connected to the elongate component, the shell members have been brought into the mated configuration, the gripping members are forced against opposite faces of the heater at longitudinally spaced intervals. The result is that the heater is forced into a serpentined configuration.

The design of the gripping members is dependent on the size of the heater and the desired pullout force. The gripping members preferably have a rectangular cross-section but other shapes, e.g. round, are useful if the gripping members can deform the heater into a serpentine shape. They may be secured to the first or second shell members or to an insulating insert which is positioned between the first and second shell members. In the most simple configuration, teeth of similar size and shape are longitudinally spaced from one another in association with both the first and the second shell members. Alternatively, the teeth may be directly opposite one another but of different lengths, e.g. a first shell member comprises a relatively long gripping member adjacent a relatively short gripping member while a second shell member comprises a short gripping member adjacent a long gripping member. When mated, the short and long teeth are opposite one another. In another design, the teeth associated with one of the shell members may be the same length while those of the other shell member are alternately long and short. These designs, as well as others, will result in a serpentine pattern as long as the heater is positioned against the teeth. The teeth may be positioned squarely on the first and/or second shell members (i.e. perpendicular to the shell members at an angle of 90° to the shell members) or be placed at an angle to the shell member. The gripping surface of the teeth may be flat and perpendicular to the base of the tooth or it may be angled for increased gripping capability. It is particularly preferred that the surface of the tooth have an angle which, when measured parallel to the base of the shell member be 1 to 15 degrees, preferably 5 to 12 degrees, particularly 7 to 12 degrees, for example 10 degrees. The tooth should be angled with respect to the opening of the inlet port so that when a pullout force is applied to the heater and/or the component the tooth will grip the heater or component more firmly. For some applications, the teeth may be serrated. Other factors which affect the strength of the connection include the distance between adjacent gripping members on the first and second shell members or other substrate (the "pitch") and the distance between the gripping surface of a tooth on the first shell member and the gripping surface of a tooth on the second shell member (the "opening"). Both the pitch and the opening may be constant or vary. In general, the thicker the heater, the fewer teeth and/or the larger the pitch and opening are needed to achieve adequate pullout strength.

Although a total of only three gripping members (two on a first shell member and one on a second shell member) is required in order to deform the heater into a serpentine shape, the most efficient gripping is generated when there is a minimum of five total gripping members. Under these conditions, three teeth are associated with the first shell member (i.e. "first teeth") and two teeth with the second shell member (i.e. "second teeth"). The five teeth preferably grip the heater in the following way. One first tooth and one second tooth grip the braid of the heater, either directly or through an outer insulating jacket; a second first tooth and a second second tooth grip directly onto the insulating jacket, and the third first tooth, which is positioned between the first and second first teeth, grips both the metal braid and the insulating jacket which is surrounded by the braid. This helps to ensure that adequate transverse force is applied to both the braid and the jacket to prevent pullout from the connector as a result of longitudinal force.

For connectors intended for a single heater and a single elongate component, adequate gripping is achieved by the use of gripping members associated with the first and the second shell members in the vicinity of the first inlet port. When the connection is between the heater and one or more additional heaters, the connection to the additional heaters must also have sufficient strain relief and pullout strength. This requires the presence of auxiliary gripping members in the vicinity of the second inlet port (when the second and third heaters are in a stacked configuration) or each of the second inlet ports (when the second and third heaters are positioned adjacent to one another). At least one first auxiliary gripping member is associated with, and preferably secured to, the first shell member, and at least one second auxiliary gripping member is associated with, and preferably secured to, the second shell member. The precise number of gripping members needed to produce a serpentined heater is dependent on the size of the heater, the presence or absence of a metal braid and/or outer insulating jacket, and the desired pullout strength among other factors. When the second and third heaters are stacked, a gripping insert is required. This insert, which comprises gripping insert members, is positioned between the second and the third heaters adjacent the second inlet port so that when the shell members are in a mated configuration and the heaters are connected to one another within the connector, the first auxiliary and the insert gripping members are forced against opposite faces of the second heater at longitudinally spaced intervals on the second heater, thus forcing the second heater to form a serpentine configuration and the second auxiliary and the insert gripping members are forced against opposite faces of the third heater within the shell at longitudinally spaced intervals on the third heater, thus forcing the third heater to form a serpentine configuration. In a preferred configuration there are three first and three second auxiliary gripping members and two gripping members on each side of a planar gripping insert. For ease of assembly it is preferred that the gripping insert be physically attached, e.g. by a strap, to either or both of the first or the second shell members.

When making the electrical connection between the heater and the component, it is important that the stripped electrodes and the braid are separated from one another in order to avoid electrical shorting. In a preferred connector design, two insulating barriers are present to separate these elements. A first insulating barrier, intended to separate the first and the second electrodes, lies between the first and the second terminal blocks and extends outwardly therefrom towards the first inlet port. A second insulating barrier lies between the second and third terminal blocks and extends outwardly therefrom towards the first inlet port. It is intended to separate the metal grounding braid from the electrodes. It is particularly preferred that the second barrier extend substantially further than the first barrier to maximize the separation between the elements. In addition, a long second barrier increases the length of exposed insulating jacket, providing a substantial distance for gripping by the gripping members and allowing maximum sealing to be achieved by the gel or other sealing material. When the electrical component comprises a heater or heaters, the region surrounding the terminal blocks may also be modified to incorporate insulating barriers.

The connector of the invention and any necessary barriers and/or inserts may comprise an insulated metal or ceramic, but preferably comprise a polymer which has an impact strength of at least 5 foot-pounds when shaped into the connector configuration as measured by tests such as ASTM D3029 or UL 746C. Suitable materials are of light weight, can be shaped by injection- or transfer-molding, and will withstand specified continuous use and intermittent use temperatures. Appropriate polymers include polycarbonate, nylon, polyester, polyphenylene sulfide, polyphenylene oxide and other engineering plastics.

In order to ensure that an adequate environmental seal is achieved between the elongate heater and the electrical component, it preferred that a viscous sealing material be present. Suitable materials include greases, adhesives, mastics, gels, and other materials, which, under compression, tend to conform around the surface of the heater and the component to make a seal. Particularly preferred as sealing materials are gels, e.g. silicone gels, such as those disclosed in U.S. Pat. Nos. 4,369,284 (Chan), 4,600,261 (Debbaut), 4,634,207 (Debbaut), 4,643,924 (Debbaut), 4,690,831 (Debbaut), 4,716,183 (Gamarra et al), and 4,777,063 (Dubrow et al), and in copending commonly assigned U.S. application Ser. Nos. 153,541 filed Feb. 1, 1988 (Chang et al), 165,452 filed Mar. 1, 1988 (Debbaut), and 271,394 filed Nov. 10, 1988 (Chang et al). U.S. Pat. No. 4,751,350 (Eaton) discloses gels used in combination with a sealing device such as an end cap for strip heaters or other electrical cables. The disclosure of each of the above-referenced patents and applications is incorporated herein by reference. The gel may be placed in one or preferably both sides of the shell members prior to use. When the shell members are formed into the mated configuration, the gel is displaced over the connection and the insulating jacket, as well as the section of the braided heater which is inside the shell. This minimizes any moisture ingress from the metallic grounding braid. In addition, the gel, which does not form a rigid covering over the connection, allows reenterability into the connector in order to check continuity.

The invention is illustrated by the drawing in which FIGS. 1*a* and 1*b* show the demated shell members 13,12 of a connector 1 which, when in its mated configuration as in FIG. 2, is suitable for making a splice between a strip heater 2 and an elongate component 8 which is also a strip heater. Each heater comprises a first elongate wire electrode 3 and a second elongate wire electrode 4 separated by a conductive polymer composition 5. The heater is surrounded first by an insulating polymeric jacket 6 and then by a metallic grounding braid 7. The braid may be surrounded by an outer insulating jacket 36. After being inserted through the first inlet port 14, the first electrode 3 is connected to the first elongate member of the elongate component (not visible) at a first terminal block 18 and the second electrode 4 is connected to the second elongate member of the elongate component (not visible) at a second terminal block 19. A first insulating barrier 25 is positioned between the first and second terminal blocks 18, 19 and serves to separate the two electrodes. The grounding braid 7 is stripped back from the end of the heater at a distance slightly past the entrance of the first inlet port 14 and is positioned around a screw insert 17 or other boss and a second insulating barrier 26 before being connected to the third elongate member of the elongate component (not visible) at the third terminal block 20. When the two shell members are mated by the means of screws 16, the heater 2 is forced into a serpentine configuration by means of first gripping members 21 which are secured to the first shell member 12 and second gripping members 22 which are secured to the second shell member 13. For this splice connector, the elongate component strip heater 3 which is inserted through inlet port 15 is also forced into a serpentine configuration by means of first auxiliary gripping members 23 attached to the first shell member 12 and second auxiliary gripping members 24 attached to the second shell member 13.

Figure 3:
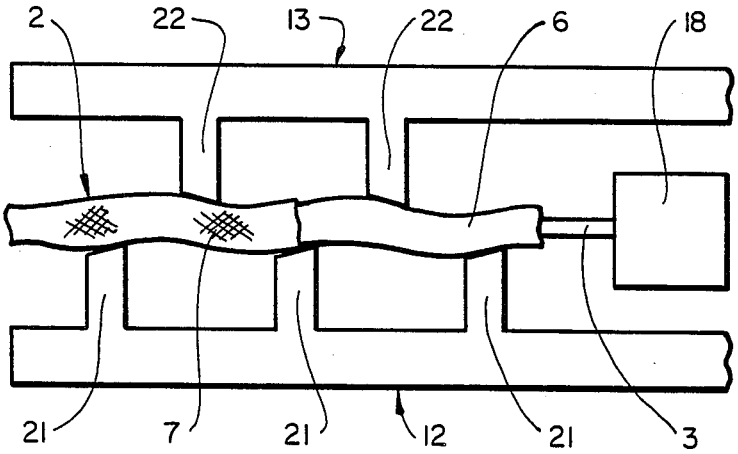
FIG. 3 is a schematic side view of the serpentine nature of the heater when positioned within the connector of the invention.

FIG. 3 is a schematic side view of a heater 2 which is gripped between first gripping members 21 which protrude from the first shell member 12 and second gripping members 22 which protrude from the second shell member 13. Both the section of the heater which is covered by grounding braid 7 and that section of the heater for which the insulating jacket 6 is exposed are in contact with two first gripping members 21 and one second gripping member 22. One first gripping member 21 is common to the two sections of the heater. After connecting electrode 3 to terminal block 18 and mating the two shell members 12,13, the heater is forced into a serpentine configuration.

Figure 5:
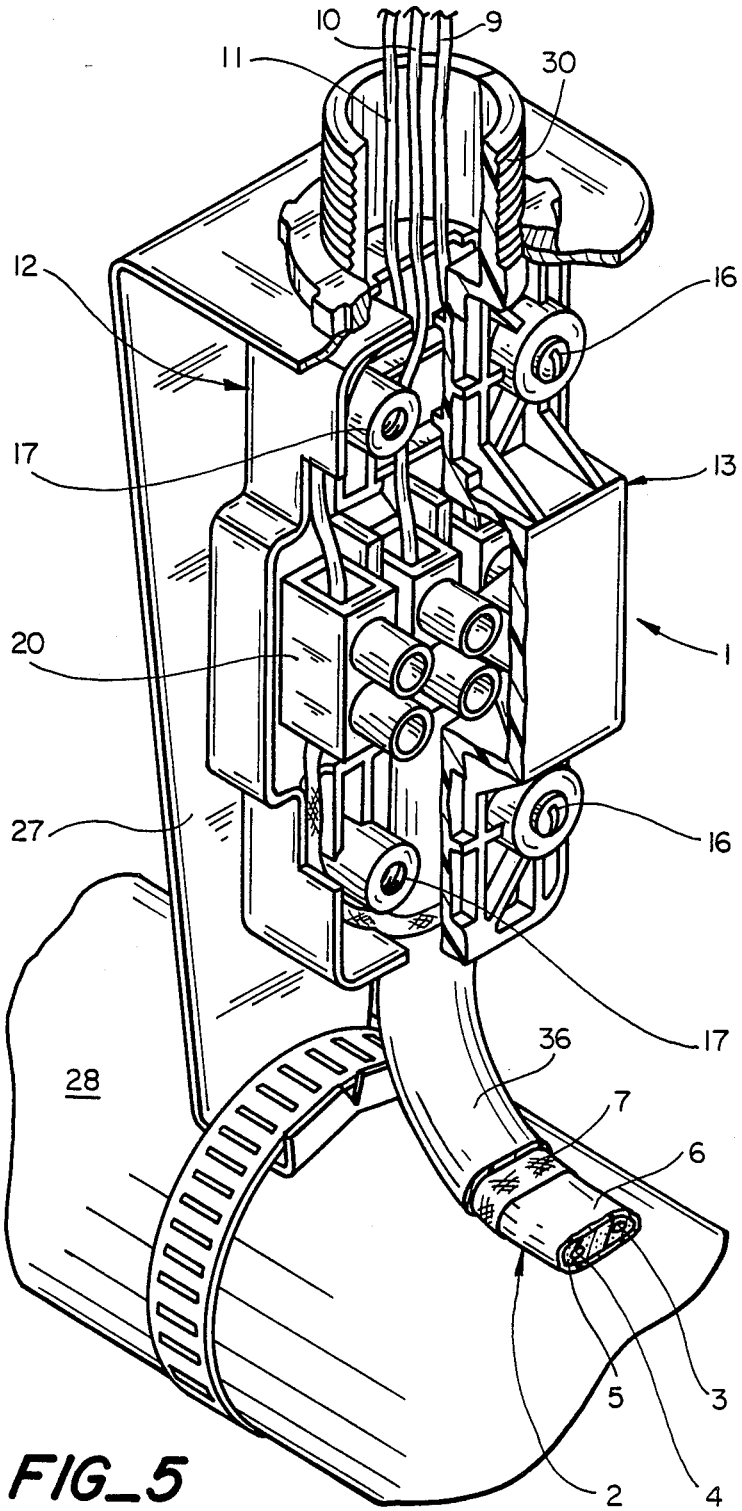
FIG. 5 shows the connector of FIGS. 3*a* and 3*b* mounted on a pipe.
Figure 6:
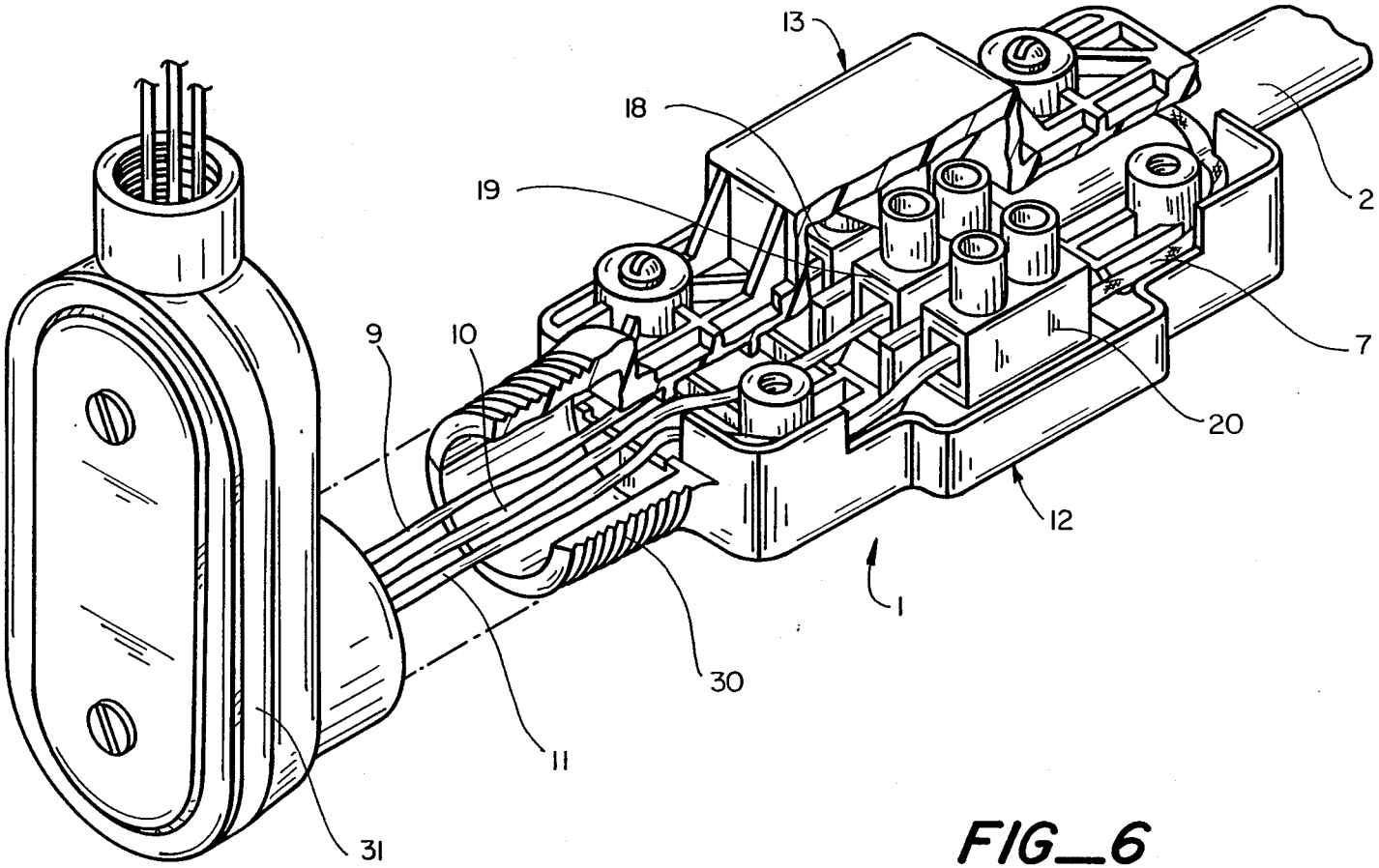
FIG. 6 shows an alternative configuration of a power connector.

FIGS. 4*a* and 4*b* illustrate the demated shell members 13,12 of a connector 1 which is suitable for connecting a heater 2 to a power lead. The power lead (as shown in FIGS. 5 and 6) comprises three elongate members 9,10,11 which are connected by means of terminal blocks 18,19,20 to the first electrode 3, the second electrode 4, and the grounding braid 7 of the heater, respectively. Gel is inserted into compartment 27 prior to mating the shell members. As shown in FIG. 5, the connector may be mounted onto a pipe 28 by means of a mounting bracket and strap. Alternatively, as shown in FIG. 6, the connector may be screwed via threads adjacent to the second inlet port 15 to a conduit connector 31 when the elongate component 3 is a power lead.

Figures 7A, 7B:
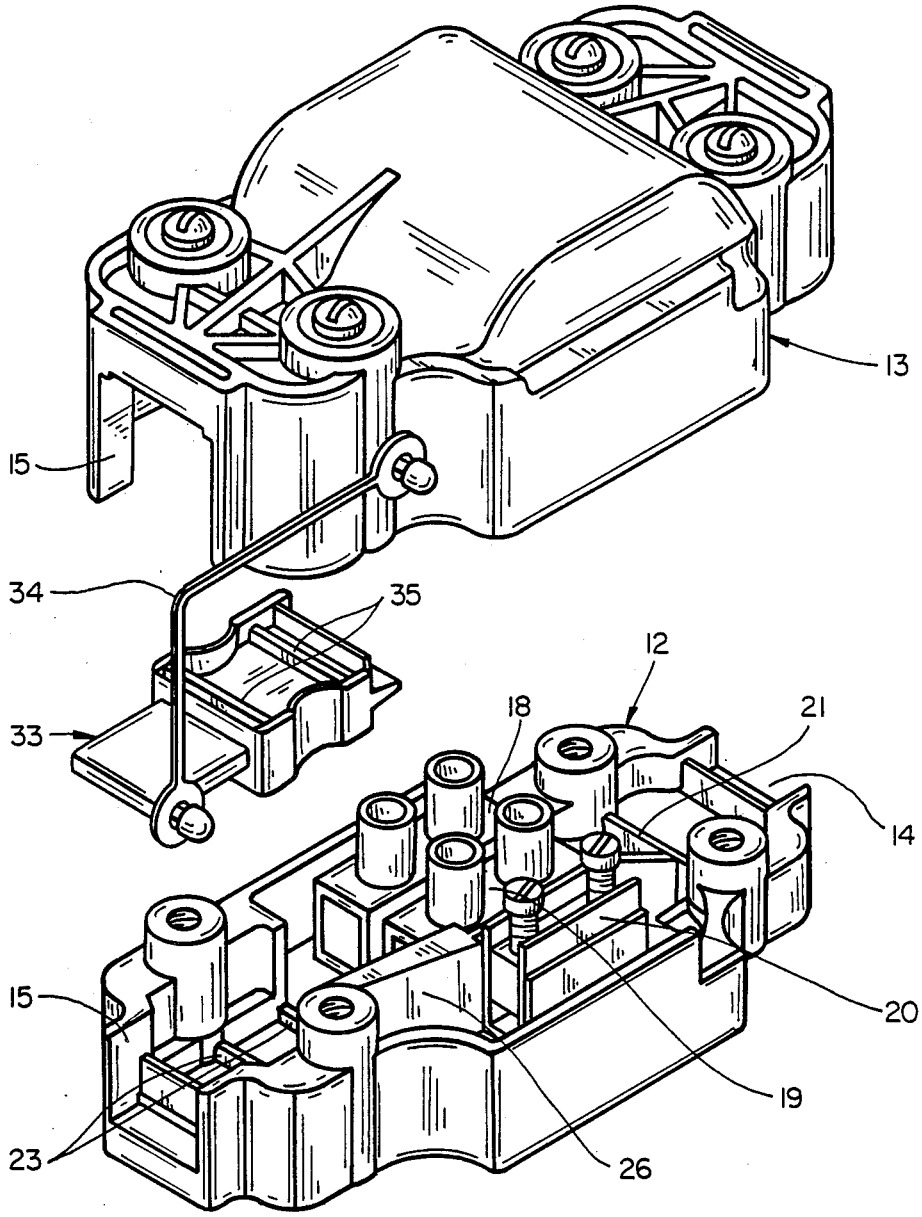
FIGS. 7*a* and 7*b* are perspective views of the components of a connector suitable for making a connection between three heaters.
Figure 8:
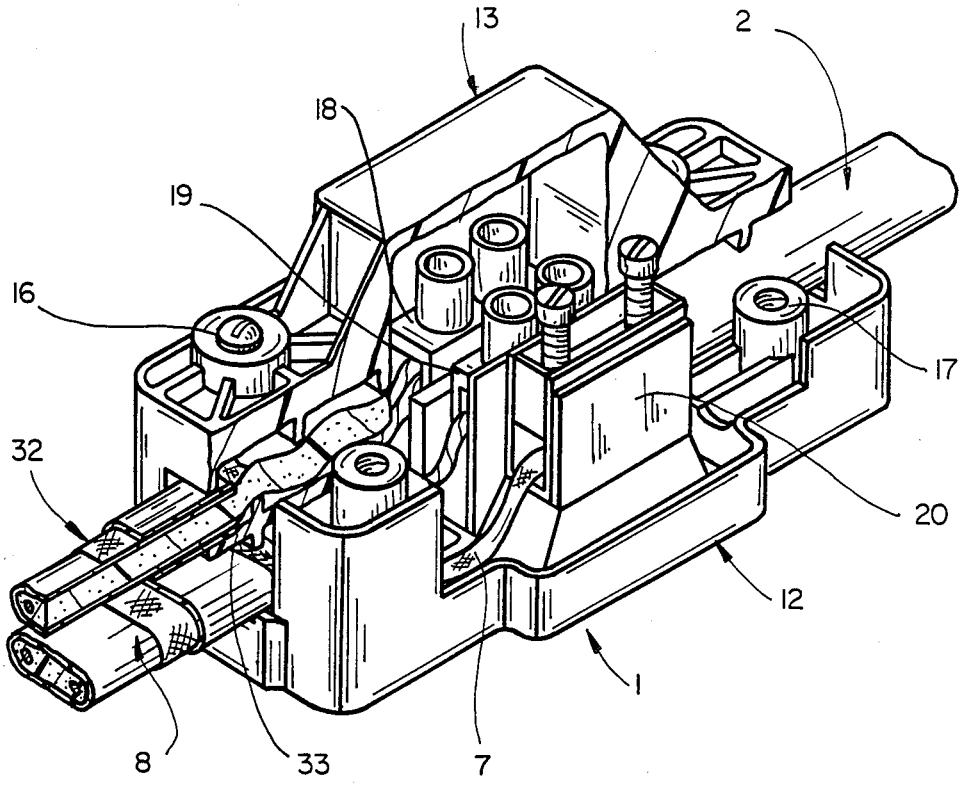
FIG. 8 shows a completed connection for the components of a connector similar to FIGS. 6*a* and 6*b*.

FIGS. 7*a* and 7*b* illustrate the parts of a connector 1 which, when in the mated configuration as in FIG. 8, is suitable for connecting a heater 2 to two elongate components 8,32 which are also elongate strip heaters. An insert 33 is attached by a retaining member 34 (not shown in FIG. 8) to the second shell member 13. The insert itself comprises insert gripping members 35. A substantial second insulating barrier 26 is present, particularly in the vicinity of the second inlet port 15. In this design the third terminal block 20 for the grounding braid is an uninsulated one-pole terminal block although the first and second terminal blocks 18,19 for the electrodes are convention insulated two-position terminal blocks.

What is claimed is:

1. A connector for connecting an end of an elongate electrical heater to an end of an elongate electrical component, said heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, and said electrical component comprising first, second and third elongate members for connection to the first electrode, the second electrode, and the grounding braid respectively, said connector comprising (1) first and second shell members which can be in (a) a demated configuration or (b) a mated configuration in which the shell members are in contact with each other and form a shell having a first inlet port for the heater and a second inlet port for the electrical component;

(2) securing means for releasably maintaining the shell members in the mated configuration;

(3) a first terminal block for connecting the first electrode to the first elongate member of said electrical component within the shell;

(4) a second terminal block for connecting the second electrode to the second elongate member of said electrical component within the shell;

(5) a third terminal block for connecting the grounding braid to the third elongate member of said electrical component within the shell; and (6) a plurality of first gripping members associated with the first shell member, and at least one second gripping member associated with the second shell member, the first and second gripping members being such that, when the shell members are brought from the demated configuration into the mated configuration after the electrical heater has been connected to the electrical component via the terminal blocks within the connector, the gripping members are forced against opposite faces of the heater within the shell adjacent the first inlet port and at longitudinally spaced intervals on the heater, thus forcing the heater to form a serpentine configuration.

2. A connector according to claim 1 wherein the first gripping members are secured to the first shell member, and the second gripping member is secured to the second shell member.

3. A connector according to claim 1 which comprises at least two second gripping members.

4. A connector according to claim 1 which comprises three first gripping members and two second gripping members.

5. A connector according to claim 1 further comprising (7) a gel component which is secured to the first or second shell member when the shell members are in the demated configuration and which is deformed and seals around the first, second and third terminal blocks when the shell members are i the mated configuration.

6. A connector according to claim 5 wherein the gel component extends outwardly from the terminal blocks towards the first inlet port so that it can directly contact and seal around the insulating jacket of the heater after the grounding braid has been removed therefrom.

7. A connector according to claim 6 wherein the first, second and third terminal blocks are secured to the first shell member, and the gel component is secured to the second shell member.

8. A connector according to claim 1 which further comprises (8) a first insulating barrier which lies between the first and second terminal blocks and extends outwardly therefrom towards the first inlet port; and (9) a second insulating barrier which lies between the second and third terminal blocks and extends outwardly therefrom towards the first inlet port.

9. A connector according to claim 8 wherein the second insulating barrier extends outwardly substantially further than the first insulating barrier.

10. A connector according to claim 1 for connecting the heater to an elongate electrical component which is a grounded power lead.

11. A connector according to claim 1 for connecting the heater to an electrical component which is a second elongate electrical heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, the connector having first and second inlet ports at opposite ends of the shell, and the shell members being substantially symmetrical about a plane between the inlet ports.

12. A connector according to claim 1 for connecting the electrical heater to second and third electrical heaters, each of which comprises (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, the connector having the first and second inlet ports at opposite ends of the shell, the second inlet port being an inlet port for the second and third heaters, and the connector comprising

(10 ) at least one first auxiliary gripping member associated with the first shell member;

(11 ) at least one second auxiliary gripping member associated with the second shell member; and

(12 ) a gripping insert which can be placed within the shell between the second and third heaters and which comprises insert gripping members; the auxiliary gripping members and the insert gripping members being such that when the shell members are in the mated configuration and the electrical heaters are connected to each other within the connector, (a) the first auxiliary and insert gripping members are forced against opposite faces of the second heater within the shell adjacent the second inlet port and at longitudinally spaced intervals on the second heater, thus forcing the second heater to form a serpentine configuration, and (b) the second auxiliary and insert gripping members are forced against opposite faces of the third heater within the shell adjacent the second inlet port and at longitudinally spaced intervals on the third heater, thus forcing the third heater to form a serpentine configuration.

13. A connector according to claim 12 wherein the gripping insert is connected to the first or the second shell member.

14. A connector for connecting an end of an elongate electrical heater to an end of an elongate electrical component, said heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, and said electrical component comprising first, second and third elongate members for connection to the first electrode, the second electrode, and the grounding braid respectively, said connector comprising (1) first and second shell members which can be in (a) a demated configuration or (b) a mated configuration in which the shell members are in contact with each other and form a shell having a first inlet port for the heater and a second inlet port for the electrical component;

(2) securing means for releasably maintaining the shell members in the mated configuration;

(3) a first terminal block which is secured to the first shell member and which is suitable for connecting the first electrode to the first elongate member of said electrical component within the shell;

(4) a second terminal block which is secured to the first shell member and which is suitable for connecting the second electrode to the second elongate member of said electrical component within the shell;

(5) a third terminal block which is secured to the first shell member and which is suitable for connecting the grounding braid to the third elongate member of said electrical component within the shell;

(6) three first gripping members which are secured to the first shell member and two second gripping members which are secured to the second shell member, the first and second gripping members being such that, when the shell members are brought from the demated configuration into the mated configuration after the electrical heater has been connected to the electrical component via the terminal blocks within the connector, the gripping members are forced against opposite faces of the heater within the shell adjacent the first inlet port and at longitudinally spaced intervals on the heater, thus forcing the heater to form a serpentine configuration;

(7) a gel component which is secured to the first or second shell member when the shell members are in the demated configuration and which is deformed and seals around the first, second and third terminal blocks when the shell members are in the mated configuration;

(8) a first insulating barrier which lies between the first and second terminal blocks and extends outwardly therefrom towards the first inlet port; and (9) a second insulating barrier which lies between the second and third insulating blocks and extends outwardly therefrom towards the first inlet port substantially further than the first insulating barrier.

15. An assembly comprising a connector, an end of an elongate electrical heater and an end of an elongate electrical component, said heater comprising (a) first and second elongate electrodes, (b) a plurality of resistive heating elements connected in parallel between said electrodes, (c) an insulating jacket surrounding said electrodes and heating elements, and (d) a metallic grounding braid surrounding said insulating jacket, and said electrical component comprising first, second and third elongate members which are connected to the first electrode, the second electrode and the grounding braid respectively, said connector comprising (1) first and second shell members which are in a mated configuration in which the shell members are in contact with each other and form a shell having a first inlet port for the heater and a second inlet port for the electrical component;

(2) securing means which releasably maintain the shell members in the mated configuration;

(3) a first terminal block which is secured to the first shell member and which connects the first electrode to the first elongate member of said electrical component within the shell;

(4) a second terminal block which is secured to the first shell member and which connects the second electrode to the second elongate member of said electrical component within the shell;

(5) a third terminal block which is secured to the first shell member and which connects the grounding braid to the third elongate member of said electrical component within the shell;

(6) a plurality of first gripping members which are associated with the first shell member and a plurality of second gripping members which are associated with the second shell member, the first and second gripping members being forced against opposite faces of the heater within the shell adjacent the first inlet port and at longitudinally spaced intervals on the heater, thus forcing the heater to form a serpentine configuration;

(7) a gel component which is within the shell and which is deformed and seals around the first, second and third terminal blocks;

(8) a first insulating barrier which lies between the first and second terminal blocks and extends outwardly therefrom towards the first inlet port; and (9) a second insulating barrier which lies between the second and third insulating blocks and extends outwardly therefrom towards the first inlet port substantially further than the first insulating barrier, the insulating jacket being directly contacted by (a) the gel component, (b) at least one first gripping member and (c) at least one second gripping member, and the metallic grounding braid being contacted, directly or through an outer insulating jacket which surrounds the braid, by (a) at least one first gripping member which is different from that which directly contacts the insulating jacket and (b) at least one second gripping member which is different from that which directly contacts the insulating jacket.

16. An assembly according to claim 15 wherein there are three first gripping members which are secured to the first shell member and two second gripping members which are secured to the second shell member.

* * * * *